United States Patent [19]

Sherrard

[11] Patent Number: 4,537,806

[45] Date of Patent: Aug. 27, 1985

[54] COMPACT ORNAMENT

[76] Inventor: Muriel Sherrard, 213 Ninth St., Hicksville, N.Y. 11801

[21] Appl. No.: 665,743

[22] Filed: Oct. 29, 1984

[51] Int. Cl.[3] ..... B44F 1/00

[52] U.S. Cl. ..... 428/7; 362/806; 428/13; 428/901

[58] Field of Search ..... 428/901, 7, 13, 913.3; 362/806

[56] References Cited

U.S. PATENT DOCUMENTS

| | | | |
|---|---|---|---|
| 4,031,313 | 6/1977 | Frantz et al. | 428/901 X |
| 4,363,081 | 12/1982 | Wilbur | 362/806 X |
| 4,511,607 | 4/1985 | White | 428/13 |

FOREIGN PATENT DOCUMENTS

| | | | |
|---|---|---|---|
| 2477977 | 9/1981 | France | 428/7 |
| 2094622 | 9/1982 | United Kingdom | 428/901 |

*Primary Examiner*—Henry F. Epstein
*Attorney, Agent, or Firm*—Michael I. Kroll

[57] ABSTRACT

A compact ornament is provided and consists of a non-conductive plate member, a plurality of sockets embedded in the plate member in any desired pattern, a light bulb connected to each socket, a printed circuit embedded in the plate member to which the sockets are connected whereby the printed circuit is electrically connected to a power source so that the light bulbs can be illuminated for viewing.

6 Claims, 8 Drawing Figures

COMPACT ORNAMENT

BACKGROUND OF THE INVENTION

1. Field of Invention

The instant invention relates generally to holiday decorations and more specifically it relates to a compact ornament.

2. Description of the Prior Art

Numerous holiday decorations have been provided in prior art that are adapted to be displayed for viewing. While these prior art units may be suitable for the particular purpose to which they address, they would not be suitable for the purposes of the present invention as heretofore described.

SUMMARY OF THE INVENTION

A principle object of the present invention is to provide a compact ornament that has a plurality of sockets with light bulbs in any desired pattern and a printed circuit embedded in a non-conductive plate member so that the light bulbs can be illuminated for viewing.

Another object is to provide a compact ornament that has the light bulbs protruding from one side of the plate member so that the plate member can be mounted on a wall.

An additional object is to provide a compact ornament that has the light bulbs protruding from both sides of the plate member so that the plate member can be mounted in an open window or closed window dead space between the storm and regular window.

A further object is to provide a compact ornament that is simple and easy to use.

A still further object is to provide a compact ornament that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
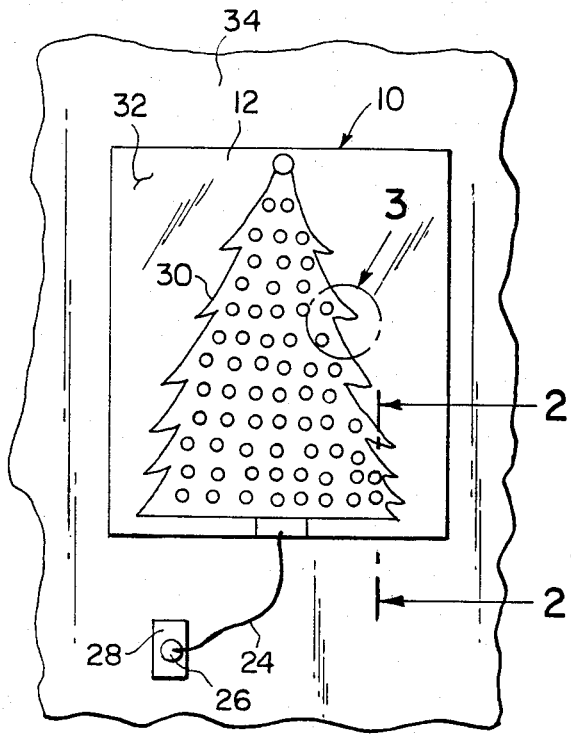
FIG. 1 is a front view of a first embodiment of the invention mounted to a wall.
Figure 2:
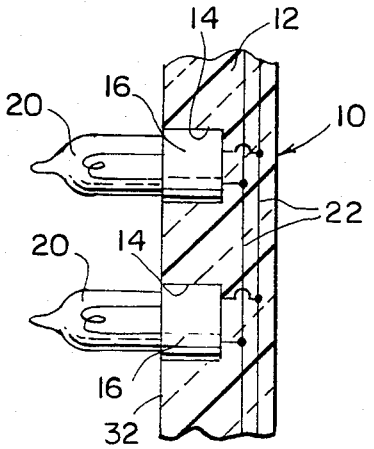
FIG. 2 is a cross sectional view taken along line 2—2 in FIG. 1.
Figure 3:
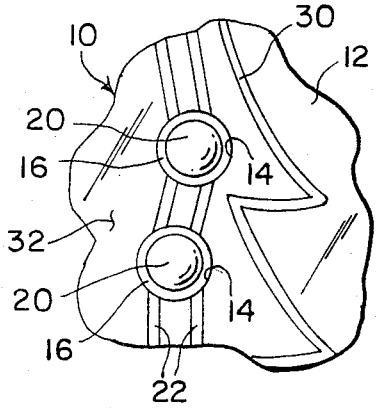
FIG. 3 is a detail view as indicated by 3 in FIG. 1.

Turning now descriptively to the drawings, in which similar referece characters denote similar elements throughout the several views, FIGS. 1 through 3 illustrates a compact ornament 10 that consists of a non-conductive plate member 12 fabricated from a clear or colored plastic material that has a plurality of apertures 14. A plurality of sockets 16 are embedded in the apertures 14 of the plate member 12 and are arranged in any desired pattern. A plurality of light bulbs 20 are provided with each light bulb connected to each socket 16.

A printed circuit 22 is embedded in the plate member 12 to which the sockets 16 are connected. A wire 24 is electrically connected to the printed circuit 22 and has a plug 26 that is inserted into a socket 28 to supply current so that the light bulbs 20 can be illuminated for viewing. A graphic display 30 such as a green outline of a Christmas tree or the like can be placed on the plate member 12 so that the light bulbs 20 will enhance the graphic display. The sockets 16 are embedded on one side 32 of the plate member 12 with the light bulbs 20 protruding therefrom so that the plate member can be mounted on a wall 34.

Figure 4:
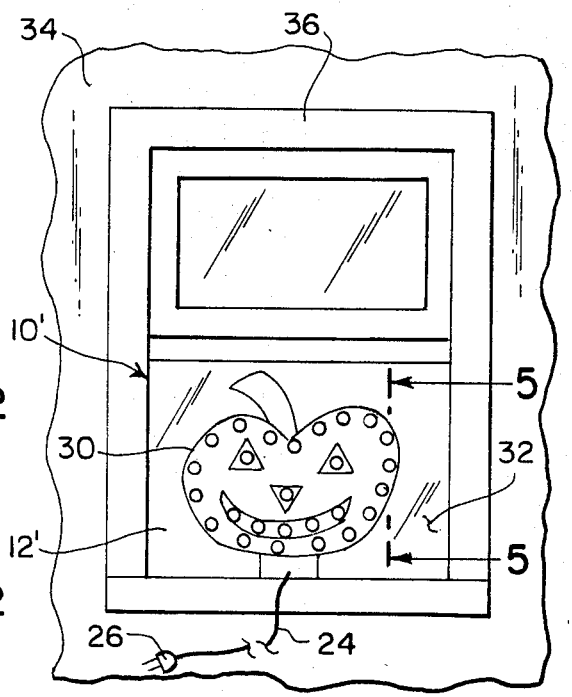
FIG. 4 is a front view of a second embodiment of the invention mounted in a window.
Figure 5:
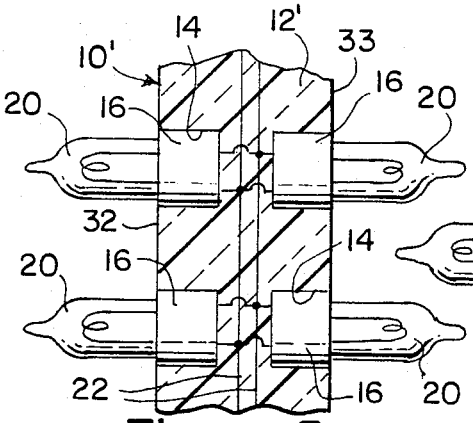
FIG. 5 is a cross sectional view taken along line 5—5 in FIG. 4.

FIGS. 4 and 5 show a second embodiment of the compact ornament 10' wherein the sockets 16 are embedded on both sides 32 and 33 of the plate member 12' with the light bulbs 20 protruding therefrom. The plate member 12' can be mounted in an open window 36 in the wall 34. The graphic display 30 shown here is a picture of a pumpkin.

Figure 6:
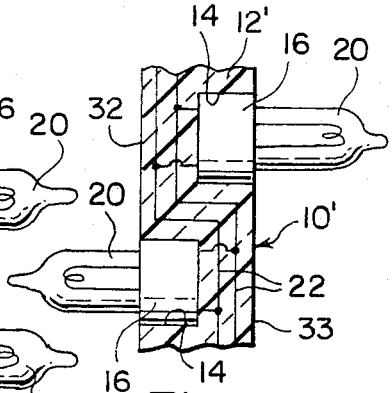
FIG. 6 is a cross sectional view similar to FIG. 5 showing a modification.

In FIG. 6 the sockets 16 are embedded and staggered on both sides 32 and 33 of the plate member 12'. The printed circuit 22 is also embedded and staggered. In this way the plate member 12' can be made thinner to better fit within the opened window 36 in the wall 34.

Figure 7:
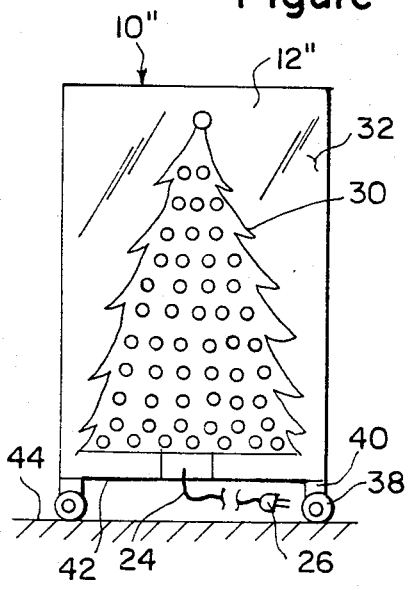
FIG. 7 is a front view of a third embodiment of the invention supported on a floor and is portable.

A third embodiment of the compact ornament 10'' is shown in FIG. 7. A plurality of rollers 38 are affixed by legs 40 to bottom 42 of the plate member 12''. The plate member can be supported on the floor 44 and is portable so that it can be moved from place to place when needed.

Figure 8:
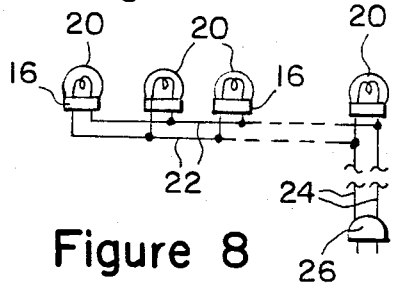
FIG. 8 is a simple circuit showing the light bulbs in a parallel wiring system.

FIG. 8 shows the circuit of the light bulbs 20. They are connected via sockets 16 to the printed circuit 22 and wire 24 with plug 26 in a parallel wiring system. In this way if one of the light bulbs 20 burns out the others will continue to function. If a series wiring system is used the whole system will be inoperative if one light bulb burns out and would not be satisfactory.

In another form (not shown) the light bulbs 20, sockets 16 and printed circuit 22 can be eliminated from the plate member 12 or 12' making the plate member non-electrical. The graphic display 30 and the apertures 14 can then be outlined with florescent paint as a substitute. Colored spotlights can be used to make the ornaments outstanding. In fact, any compact ornament either electrical or non-electrical should be sprayed or painted in clear, sparkly, stained glass or florescent paint to enhance its beauty.

The invention could also contain a vertical pole, a balancing attachment weight for height and width or a suspension hook from the ceiling so as not to be dangerous when used. The compact ornament can be made in various materials, such as fireproof wood, cardboard and the like. A series of eye hooks can be embedded in any material used so that flat ornaments and/or garlands may be attached thereto.

Besides being compact the invention would be completely safe for anyone not mentally capable of realizing the danger of small objects being put into mouths, ears, etc. The locks on the windows would prevent people from getting to the bulbs and removing them.

Each design should be pre-drilled for hanging or fastening to windows or between hangers, stands, etc. Existing mirror hangers may be used for storing the compact ornaments or may be hung on walls for viewing. According to size the compact ornament with all lights removed may be fastened to unused air space behind and attached to furniture, closet walls, doors, etc. and anywhere there is one half to one inch clearance. Conventional hinges, slides and fasteners may be used to install the compact ornaments in any desirable area.

Primarily the compact ornament is designed to be used inside a building. It may be strengthened for outside use as well or used inside enclosed show cases like theatre walls have.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A compact ornament connectable to a power source and which is self storing, easily attached, and may be used as scenery, a room divider, a replacement in screen tracks of windows, a space saver, and a sliding glass door, comprising:

(a) a flat planar non-conductive plate member containing a plurality of apertures;

(b) a plurality of sockets embedded in said plurality of apertures of said flat planar non-conductive plate member and arranged in a predetermined pattern;

(c) a plurality of light bulbs, each light bulb of said plurality of light bulbs being removeably mounted to each socket of said plurality of sockets so that said each light bulb is easily replaceable;

(d) a printed circuit embedded in said flat planar non-conductive plate member and to which said plurality of socket are electrically connected in parallel so that when at least one light bulb of said plurality of light bulbs burn out the remaining at least one light bulb will stay lit; and (e) means for electrically connecting said printed circuit to the power source so that said plurality of light bulbs can be illuminated for viewing.

2. A compact ornament as recited in claim 1, wherein said plate member further comprises a graphic display thereon so that said light bulbs wil enhance said graphic display.

3. A compact ornament as recited in claim 2, wherein said plate member is fabricated from a plastic material.

4. A compact ornament as recited in claim 3, wherein said sockets are embedded on one side of said plate member with said light bulbs protruding therefrom so that said plate member can be mounted on a wall.

5. A compact ornament as recited in claim 3, wherein said sockets are embedded on both sides of said plate member with said light bulbs protruding therefrom so that said plate member can be mounted in one instance in an open window and in another instance in a closed window.

6. A compact ornament as recited in claim 3, further comprising a plurality of rollers affixed to bottom of said plate member so that said plate member can be supported on a floor and is portable.

* * * * *